US005724905A

United States Patent [19]

Pizzey

[11] Patent Number: 5,724,905

[45] Date of Patent: Mar. 10, 1998

[54] SAILBOATS

[75] Inventor: John Kingston Pizzey, Brisbane, Australia

[73] Assignee: Sarrinen Pty Ltd, Australia

[21] Appl. No.: 492,017

[22] PCT Filed: Jul. 26, 1993

[86] PCT No.: PCT/AU93/00377

§ 371 Date: Oct. 16, 1995

§ 102(e) Date: Oct. 16, 1995

[87] PCT Pub. No.: WO94/16941

PCT Pub. Date: Aug. 4, 1994

[30] Foreign Application Priority Data

Jan. 22, 1993 [AU] Australia ..... PL6945
May 31, 1993 [AU] Australia ..... PL9108

[51] Int. Cl.[6] ..... P63B 35/00

[52] U.S. Cl. ..... 114/39.1; 114/102; 114/274

[58] Field of Search ..... 114/39.1, 39.2, 114/89, 90, 91, 92, 93, 102, 103, 271, 274, 275

[56] References Cited

U.S. PATENT DOCUMENTS

| | | | |
|---|---|---|---|
| 2,756,711 | 7/1956 | Simpson | 114/39.1 |
| 3,173,395 | 3/1965 | Laurent | 114/39.1 |
| 3,223,065 | 12/1965 | Wilson | 114/39.1 |
| 3,304,899 | 2/1967 | Weatherly | 114/39.1 |
| 3,747,549 | 7/1973 | Shutt . | |
| 3,870,004 | 3/1975 | Bailey | 114/39.1 |

FOREIGN PATENT DOCUMENTS

| | | |
|---|---|---|
| 272586 | 6/1965 | Australia . |
| 58582/80 | 12/1980 | Australia . |
| 37708/85 | 7/1985 | Australia . |
| 32039/93 | 7/1993 | Australia . |
| 2524416 | 10/1983 | France . |
| WO87/01352 | 3/1987 | WIPO . |

*Primary Examiner*—Stephen Avila
*Attorney, Agent, or Firm*—Andrus, Sceales, Starke & Sawall

[57] ABSTRACT

A proa sailing vessel has spaced hulls each having underwater shapes which are substantially symmetrical about a central athwartship axis and a mast which may be pivoted between forwardly inclined attitudes relative to the respective ends of the vessel. The sail is in the form of an isosceles triangle which is set to leeward of the mast whereby either opposed edge may be selectively tensioned between the forwardly inclined mast and the front end of the vessel. The mast extends upwardly from the leeward side of the main hull and is inclined to leeward to assist in self-righting or the vessel.

21 Claims, 5 Drawing Sheets

SAILBOATS

This invention relates to monohull and multihull sailboats and in particular it relates to sailboats of the type generally referred to as press which are able to be sailed in both directions.

Many attempts have been made in the past to provide a proa type multihull sailing vessel configuration which will be efficient in use and simple to construct and handle. Effective steering in both directions has proven the most difficult problem to date. Another disadvantage associated with practically all types of multihull sailing vessels is their relatively wide beam which prevents them from accommodating berths designed for monohull vessels. This has greatly inhibited the acceptance of multihull sailing vessels.

Furthermore desirable characteristics in such sailing vessels, apart from the normally required characteristics of being able to sail efficiently to windward and off the wind are characteristics relating to the performance of the boat during a tacking manoeuvre or a reversing or shunting manoeuvre as it is during these times that most difficulties arise as opposed to subsequently when the sails have been trimmed and the vessel may be steered to maintain its way.

In proas a desirable characteristic is that when trimming the sail or sails for movement from a stable stationary position for movement in either direction, that the action of trimming the sail(s) will automatically induce the vessel to move off in the desired direction without further immediate actions being taken by the occupants to maintain the desired heading of the vessel.

It is also a desirable characteristic that the sail(s) be able to be reefed and hoisted or lowered independent of the direction of sailing of the vessel and that such vessels, especially when in the form of small craft such as trailerable craft, are able to right themselves from a knockdown due to wind action either automatically or without outside assistance. Furthermore in trailerable vessels it is desirable to provide a configuration which can perform adequately while at the same time being economical to manufacture and easy to rig, and launch and retrieve from and onto a trailer.

The present invention aims to provide improvements to sailing vessels and/or sails and rigs therefor which will exhibit one or more of the abovementioned characteristics, which may be utilised separately or in combination and which will be reliable and efficient in operation.

With the foregoing in view, this invention in one aspect resides broadly in a proa sailing vessel including:

hull assembly;

a mast assembly and supporting means therefore;

a sail assembly supported by the mast assembly and including opposed trim lines for trimming the sail assembly on respective port and starboard tacks;

rudder assemblies which may move between operative and inoperative attitudes, and connection means connecting the trim lines to respective rudder assemblies whereby the action of trimming the sail for operation on a respective port or starboard tack will dispose one rudder assembly to its operative attitude and the other opposed rudder assembly to its inoperative attitude Suitably in a multihull vessel the hull assembly has an underwater shape which is substantially symmetrical about a central athwartship axis. For a monohull vessel the hull may have side ballast at the upwind side of the vessel and extra buoyancy on that side to compensate when in the non-sailing attitude.

Preferably the operative rudder assembly is at or adjacent the rear of the vessel. Preferably each rudder assembly includes a blade portion which moves such as by pivoting from an inoperative attitude substantially above the water to its operative attitude. Suitably the leading rudder blade is retracted from the water or at least partially retracted such that the centre of lateral resistance offered by the of the rudder assemblies is biased towards the rear of the athwartship centreline. Suitably the head portions the rudder blades are maintained captive between opposed side walls which converge upwardly whereby the lowered rudder blade may pivot between the lower widely spaced portions of the side walls and the raised rudder blade is held against pivoting between the upper closely spaced portions of side walls. This arrangement ensures positive centering of the leading rudder upon retraction of the leading rudder blade. Alternatively the rudders may be fixed shallow draft rudders and be provided with locking means for selectively holding in the inoperative position.

The rudder or rudders may be mounted in or on the hull or hulls of the vessel or they may be suspended from an structural portion of the vessel elevated above the water Preferably the rudder assemblies are supported on the leeward hull or suspended intermediate the hulls in a multihull vessel.

The sail assembly may be of any desired type such as conventional main sail separately or in combination with furling head sails at each end, a pivotable balanced rig which may be a free standing rig such as a pyramid rig. The sail assembly may extend vertically or inclined from any desired athwartship position or from adjacent either side of the vessel.

In another aspect a preferred form sail assembly includes an edge which may be selectively tensioned between the mast assembly and a leading portion of the hull assembly. The sail is suitably in the form of an isosceles or equilateral triangle having equal length upstanding edges either of which may be tensioned to constitute an operative leading edge, the sail being controlled by respective trim lines which run from the opposed lower corners of the sail to respective turning blocks or the like at the opposite ends of the hull assembly.

It is also preferred that the sail assembly be provided with hoisting connections whereby the sail may be hoisted along a line extending between an upper portion of the mast and the hull assembly. Suitably the hoisting line may be tensioned to assist hoisting and dropping the sail and slackened so as not to interfere with the sail trim. The hoisting connections may be provided along the luff of the sail assembly and the hoisting line may be slightly longer than the luff and extend from a position adjacent the upper sail hoisting block to the tack of the sail such that it may be tensioned by a running line to the tack or the hoisting line to permit the sail to be hoisted therealong.

Alternatively and preferably the hoisting connections extend down a medial section of the sail such that the sail may be hoisted along the hoisting line with the central portion of the sail maintained to windward and the opposite side portions able to stream to a common leeward side of the hoisting line.

A sail assembly incorporating such hoisting means may constitute an invention according to a further aspect of this invention and may be in the form of a headsail or a spinnaker.

According to another aspect of this invention the mast assembly may be pivoted between opposite forwardly or rearwardly inclined attitudes relative to the respective ends of the vessel such that the centre of effort of the sail assembly may be biassed toward either end of the vessel.

In yet another aspect of this invention a vessel's mast is supported so as to support the tensioned leading edge of the sail inclined to leeward whereby its overturning effect is reduced immediately the vessel heals causing feathering of the sail. An athwartship inclination of between ten and twenty degrees could be utilized or of course the mast lean could be adjusted beyond the above limits to vary the inclination of the sail's leading edge to suit the sailing conditions. For example the inclination may be ten degrees for light winds, fifteen degrees for moderate winds and thirty degrees for strong winds. Preferably the sail configuration supported by the leewardly inclined mast is such that the weather helm induced by the outward lean of the sail plan is counteracted by a forward positioning of the centre of effort of the sail configuration. This forward positioning may be assisted by forward pivoting of the mast from a central position.

In yet another aspect this invention resides broadly in a proa sailing vessel including:

a hull assembly having an underwater shape which is substantially symmetrical about a central athwartship axis;

a mast assembly and supporting means therefore;

a sail assembly supported by the mast assembly, the sail being in the form of an isosceles or equilaterl triangle having equal length upstanding edges either of which may be tensioned to constitute an operative leading edge, the sail being controlled by respective trim lines which run from the opposed lower corners of the sail to respective turning blocks or the like at the opposite ends of the hull assembly, and the opposed trim lines extending through respective running blocks which may be moved to position the operative sail tack to windward and position the operative sail clew to leeward and said respective running blocks being interconnected whereby tensioning of the trim lines move the respective running blocks to their operative positions.

For example the trim lines may pass through fixed blocks disposed at the opposite windward ends of the vessel and running blocks may be supported at opposite ends of a line which pass through fixed blocks disposed at the opposite leeward ends of the vessel, the arrangement being such that when the operative leading edge is tensioned the running block on the leading trim line is pulled to windward which pulls the running block at the opposite end to leeward such that the lateral sheeting position of the aft trim is displaced to leeward relative to the sail tack. Alternatively the running blocks may be interconnected to the rudder assemblies such that movement of a rudder to its operative position pulls the aft running block to leeward. Thus the sail is automatically positioned inclined rearwardly away from to the fore and aft axis of the vessel on each tack.

The vessel may be provided with a rudder or other steering means at one end only if desired. Preferably however, the vessel is provided with rudders at each end which may be operated independently and having a blade which may be raised when not in use.

In another aspect a vessel according to this invention has a hull assembly provided with hydrofoil means at its windward side which serve to lift the windward side. The hydrofoil means may be disposed vertically such that lift becomes apparent only after the vessel heels, but preferably the hydrofoil means is inclined to windward whereby it assists in lifting the windward hull above the water. The lift generated may be adjustable by adjusting the angle of attack of the hydrofoil means or by adjusting the depth of the hydrofoil beneath the windward hull or its lateral inclination. It is also preferred that the sail, displacement, hydrofoil characteristics be such that as the vessel heels, at or before or adjacent the point of exit of the hydrofoil means from the water the resultant reduction in hydrofoil lift and simultaneous reduction in overturning moment created by leewardly inclined sail(s) will cause the overturning moment to be less than the righting moment so that n use, the vessel will sail in a balanced attitude with the windward hull above the water.

The hydrofoil means may be of and desired type but preferably the hydrofoil means is in the form of a centreboard or leeboard(s) which may be depth adjustable and inclined downwardly to windward. The or each hydrofoil means may be pivotable about a substantially horizontal axis whereby it may be pivoted forwardly to increase its angle of attack. Furthermore, the pivotal movement of the hydrofoil means may be coupled to the mast so that as the mast pivots the hydrofoil means is or are pivoted to an operative position.

It is also preferred that the hydrofoil means also provide lateral resistance required for balancing the sail forces imposed on the vessel. Preferably the hydrofoil means provides a major component of the lateral resistance whereby upon heeling to a sufficient extent to cause the retraction of the hydrofoil means from the water, the vessel will slip sideways and the sail will stall. This effect may be enhanced by forming the hull with substantially straight longitudinal runs for a major portion of the length of the hull or other shallow draft configuration.

In yet a further aspect this invention resides broadly in a proa sailing vessel including:

a twin hull assembly having respective spaced underwater shapes which are substantially symmetrical about a central athwartship axis;

a deck assembly between the twin hulls;

a mast assembly and supporting means therefore;

a sail assembly, and wherein;

said hull assembly has an overall beam/length ratio of between one is to three and one is to two and there being provision for ballasting the windward hull. The ballast may be permanent or water ballast or a combination of fixed and adjustable ballast as required.

Preferably the sail assembly is of the type defined above which has free luffs adapted to be actively tensioned for each tack and whereby the sail may set to the leeward side of the vessel and the hull assembly is of monocoque form to achieve the necessary stiffness with commonly used production methods.

Ballasting of the windward hull of a proa does not incur the weight penalty of a catamaran which must carry ballast in both hulls or provide means of transferring ballast between the hulls. Preferably the leeward hull constitutes an accommodation hull which extends at least partway across the deck assembly spanning the spaced hulls. Suitably the overall beam is such that the vessel is sufficiently narrow to be trailed legally on highways and/or sufficiently narrow to be accommodated in marina pens adapted for accommodating monohull vessels. It is also preferred that the vessel be provided with a moveable crew support which may be moved such as by sliding or pivoting between a position within the confines of the vessel and an extended position at which the crew support extends to windward of the windward hull. Preferably the vessel includes a control cockpit which opens to windward and the moveable crew support moves to and from the open cockpit. Suitably the cockpit or bridgedeck spanning the hulls has a length which approaches the overall beam of the vessel whereby the crew weight may move aft sufficient to counteract the nose burying effect of the sails. It is also preferred that the length of the windward or flying hull be approximately the same as the accommodation hull whereby a sail assembly of the isosceles triangle type defined above may extend between the masthead and the front of the windward hull. Suitably the hull configuration is such that the hulls and underside of the deck assembly spanning the hulls may be moulded as a one piece plastics shell, reinforced as required.

In order that this invention may be more readily understood and put into practical effect, reference will now be made to the accompanying drawings which illustrate typical embodiments of the invention and wherein.

Figure 5:
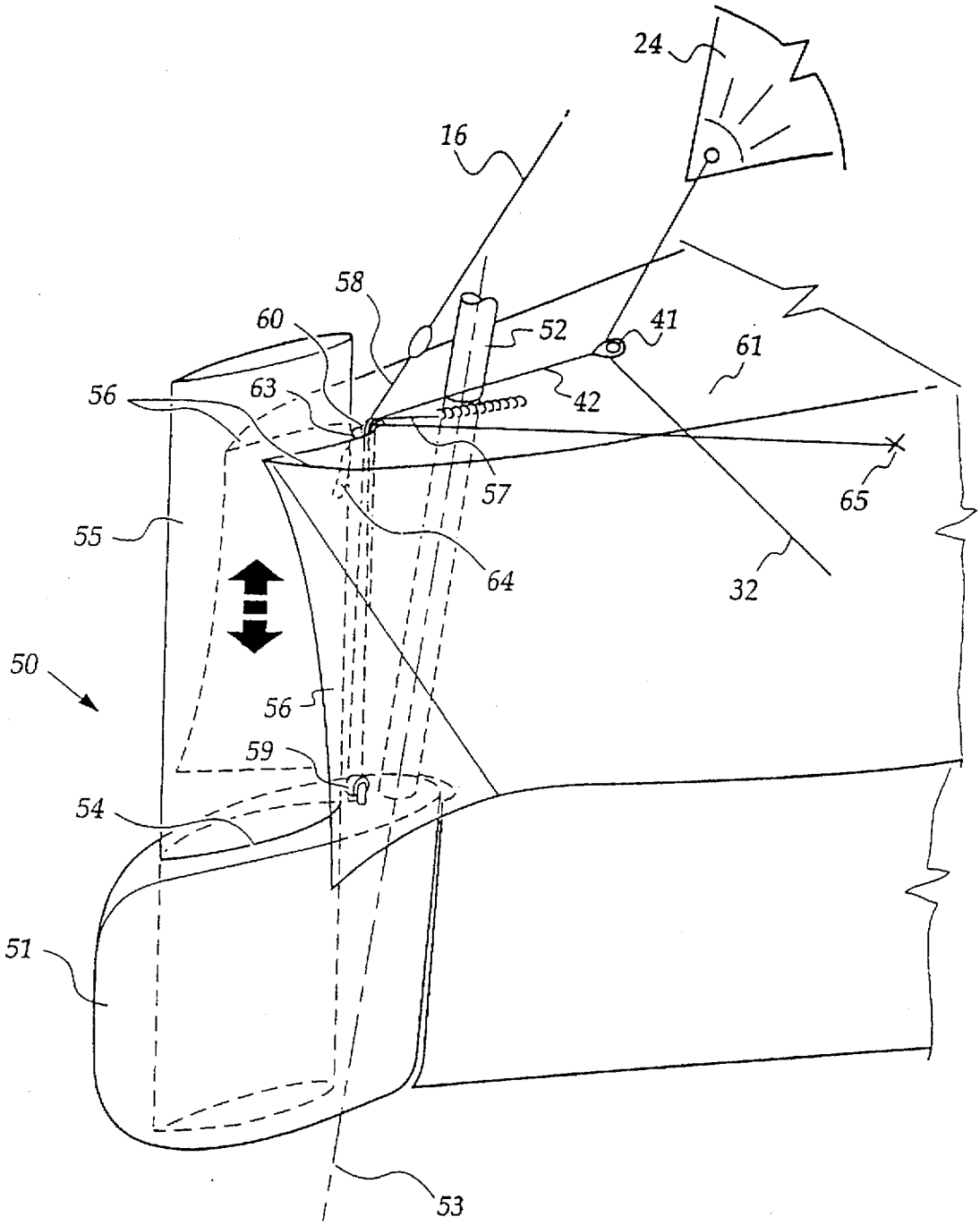

FIG. 5 diagrammatically illustrates the rudder details.

As illustrated the sail boat includes a windward hull or float 11 and a leeward hull 12 which in this embodiment is an accommodation hull. The mast 13 is pivotally connected at 14 to the leeward side of the main or accommodation hull 12 and extends upwardly and outwardly therefrom. Fixed equal length stays 15/16 extends from the masthead to each end of the vessel 10. The stays 15/16 are of such length that the mast 13 may pivot fore and aft to either of it opposite forwardly inclined attitudes [illustrated in full and dotted outlines in FIG. 1] through about twenty-five degrees to alternately tension either stay 15/16.

A tension/compression strut 17 extends from the windward side of the main hull 12 to an intermediate portion of the mast and jumper stays 18 pass about spreaders 19 associated with the connection for the tension/compression strut 17 and support the upper end of the mast. The lower end of the strut 17 is pivotally connected to the hull at 20 whereby the mast 13 together with the jumper stays 18 and strut 17 may pivot as a unit to either one of the forwardly inclined attitudes.

A sail hoisting halyard 21 extends about a block 22 at the upper end of the mast 13 and is adapted to be connected to the head 23 of a isosceles triangle shaped sail 24. A hoisting line halyard 25 extends about a block 26 adjacent the upper end of the mast 13 and is adapted to be connected to a hoisting line 27 passing through hoisting guides 28 fixed to the sail assembly at vertically spaced locations along the centre line thereof as illustrated at 29. The lower end of the hoisting line 27 passes to a car 30 slidable along a track 31 or line extending along the outer edge 25 of the hull 12. The hoisting line may be raised and lowered and selectively tensioned or freed by the halyard 21. Control lines 32 and 33 pass from the lower corners of the sail 24 about return blocks at opposite ends of the windward hull 11 to winches 36 and 37 adjacent the cockpit 40. The control lines pass through turning blocks 41 provided with automatic athwartship adjustment by means of lines 42 associated with the rudder blade, such that the leading edge or luff 43 of the sail is moved to windward relative to the trailing edge so as to provide a positive sheeting angle relative to the inwardly disposed position of the luff 43. The sail 24 is a symmetrical sail having both edges 41 reinforced whereby either may be tensioned to form the leading edge or luff 43 of the sail.

An inclined hydrofoil 45 is located centrally of the float 11 to provide both leeway resistance and lift to the windward side of the boat 11. The hydrofoil 45 is supported in a case 46 whereby it may be raised and lowered. The lift generated by the hydrofoil may be adjusted by adjusting the depth of the hydrofoil or its angle of attack. Suitably the foil is flat on the leeward side and part cylindrical on the windward side.

The sail size, displacement, hydrofoil characteristics are such that as the vessel 10 heels, and prior to the point of exit of the hydrofoil 45 from the water the resultant reduction in hydrofoil lift and simultaneous reduction in overturning moment created by the leewardly inclined sail being further inclined away from the wind, and thus feathered, a balance will be achieved whereby the vessel 10 will sail in a stable condition with the float clear of the water but with sufficient board in the water to enable the vessel to sail to windward.

Thus in many conditions including relatively light wind conditions the vessel 10 may be adjusted to fly the windward float 11 and take advantage of the support by the hydrofoil 45 which will create less drag. This is illustrated by the alternate waterline datum 48 illustrated in FIG. 3.

Figure 1:
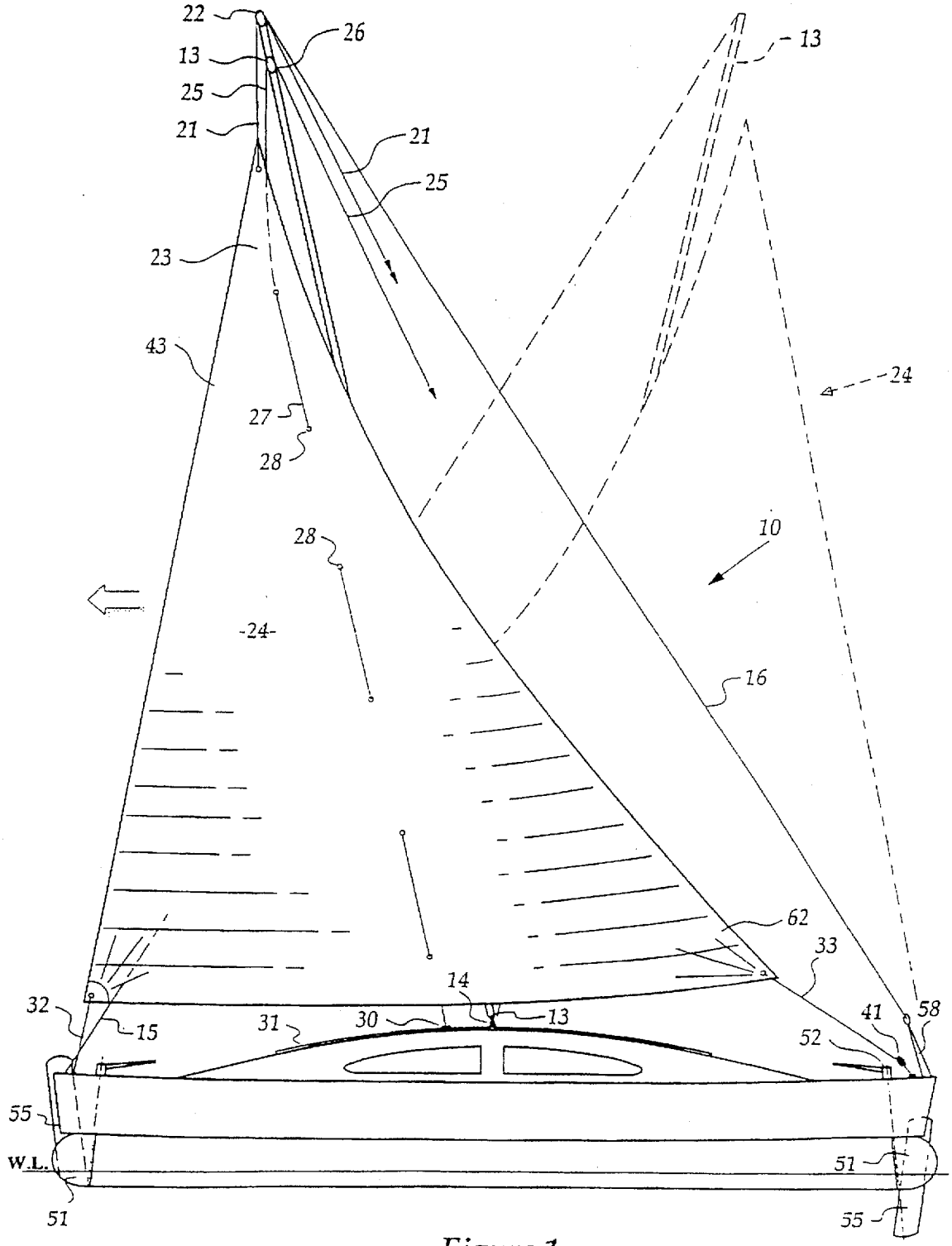
FIG. 1 is a side view of the vessel looking from the leeward side.
Figure 2:
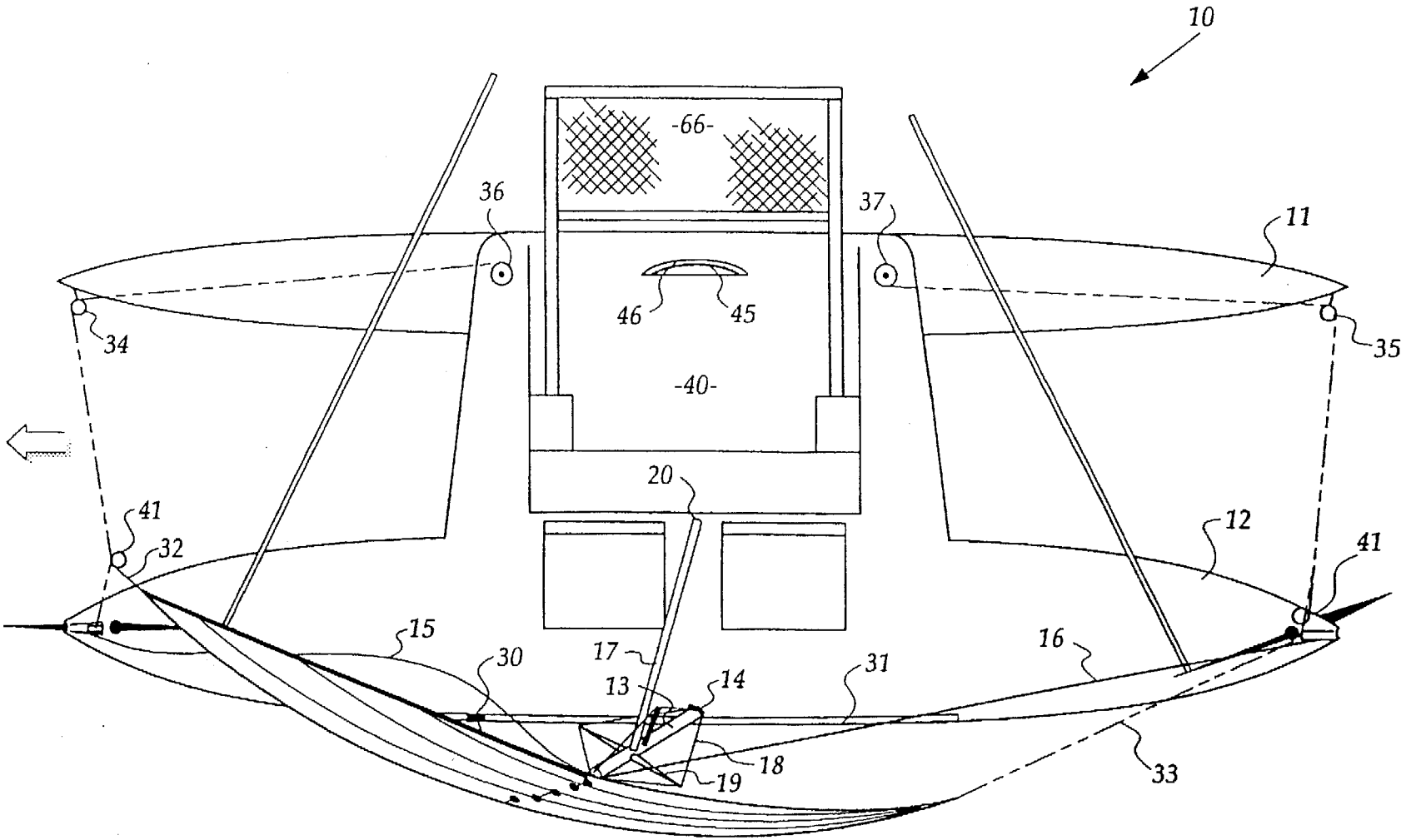
FIG. 2 is a plan view of the vessel illustrated in FIG. 1.

A rudder assembly 50 is provided as an extension of each end of the main hull 12. Each rudder assembly 50, as illustrated in FIG. 5 includes a case 51 supported by a rudder shaft 52 which extends upwardly through the main hull 12 and exits inwardly of the adjacent hull end extremity so that the rudder case pivots about the axis 53. A rudder blade slot 54 passes through the case 51 at an angle to the axis 53, as illustrated so that when the rearmost blade 55 is lowered it extends beneath the hull, as illustrated in FIG. 1, and when the front blade 55 is raised it extends upwardly between the opposed hull extensions 56 whereby it is centralised and held in the central position. The blades are automatically raised and lowered to suit the direction of travel.

When the mast is pivoted forwards, that movement is translated through the backstay to the rear rudder blade by an operating line 58 passing from the upper portion of the blade 55 through a pulley 59 on the case 51 for return about a pulley 60 on the deck 61 to connect to the respective stay 15/16 as illustrated. This pulls the rear rudder down. At the same time tensioning of the leading edge of the sail 24 causes the running block 41 to be pulled toward the turning block 35. The running block 41 connects to a line 42 which passes through a deck black assembly 63 down and around a cheek block 64 fixed to the blade 55 for return through the deck block assembly 63 to a cleat 65 located on the deck. This may be released or adjusted as desired. It is also preferred that the line which pulls the rudder down be releasable to permit the rudder blades to be raised for operation in shallow water.

In use the sail is rigged ready for use by connecting the ends of the hoisting line 27, which is permanently rove through the guide apertures 28 in the sail 24, to the car 30 and the halyard 25 and hauling its upper end to the top of the mast 24. The halyard 21 is then connected to the head of the sail 24 and the control lines 32 and 33 are connected to the lower corners of the sail 24. The control lines 32 and 33 are freed from the winches 36 and 37 and the sail 24 is hoisted along the tensioned hoisting line 27 by halyard 21. When the sail 24 is hoisted opposite portions of the sail will flutter side by side to leeward of the hoisting line 27.

When so rigged the vessel wall sit with the main hull 12 to leeward with both sides of the sail 24 streaming away from the side of the boat and with the centreboard 45 disposed in the float 11 providing the appropriate resistance in the water inducing the vessel to sit in its preferred windward leeward configuration.

When either control line such as line 32/33 is tensioned the mast 13 is pulled to incline in the forward direction such that the forward disposition of the sail 22 biases the boat for forward movement in that direction as illustrated by arrow 34. This action also raises the back of the sail so that the sheet, control line 33, substantially bisects the clew 62 of the sail 24. The tensioned hoisting line 23 may be let free or its tension reduced such that the sail may stream of feather from the tensioned edge or operative luff 43 and assume a head to wind position with the sail streaming in conventional manner. As soon as the control line 33 is tensioned, it becomes the sheet which controls the sail and the vessel moves off in the desired direction. Full control is provided by the sheet 33 and the trailing rudder blade 55, the leading rudder blade 55 being raised automatically upon tensioning of the leading edge of the sail.

When going to windward in direction illustrated and the control line 32 is released, the vessel 10 will stop substantially head to wind or slightly off the wind and be blown backwards such the mast assumes an oppositely inclined attitude inducing movement of the vessel in the opposite direction. The opposite control line 33 is tensioned and the previously tensioned controlled line 32 becomes a control sheet. Thus the vessel may be controlled with two lines only and will move quickly between opposite tacks. For efficient downwind sailing, the front winch line 42 may be released or lengthened to enable the luff of the sail to be hauled to windward so that the sail may be set spinnaker-like. For this purpose the length of the line 42 is adjusted at the cleat 65.

Figure 3:
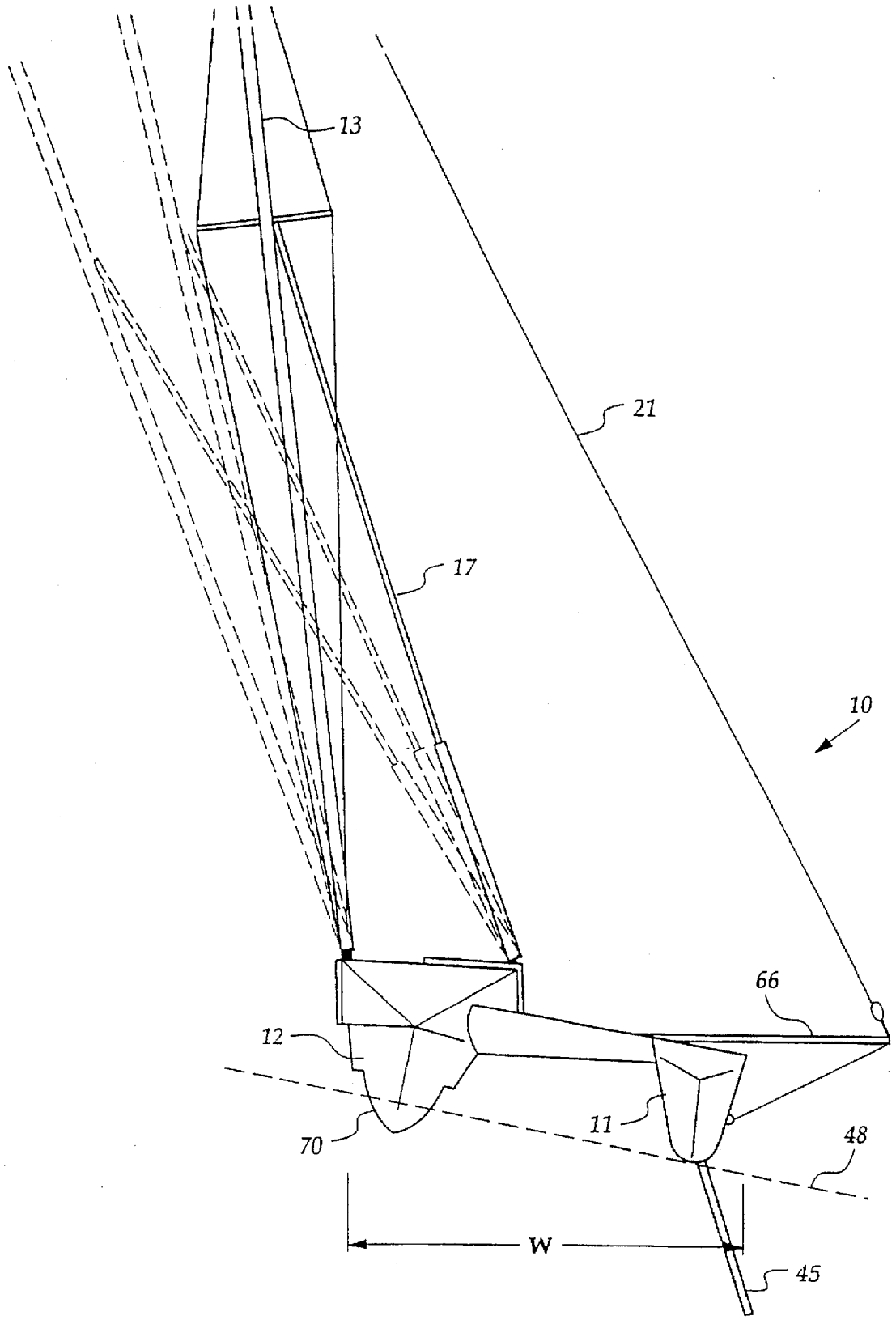
FIG. 3 is an end view of the vessel looking from the leeward side.
Figure 4:
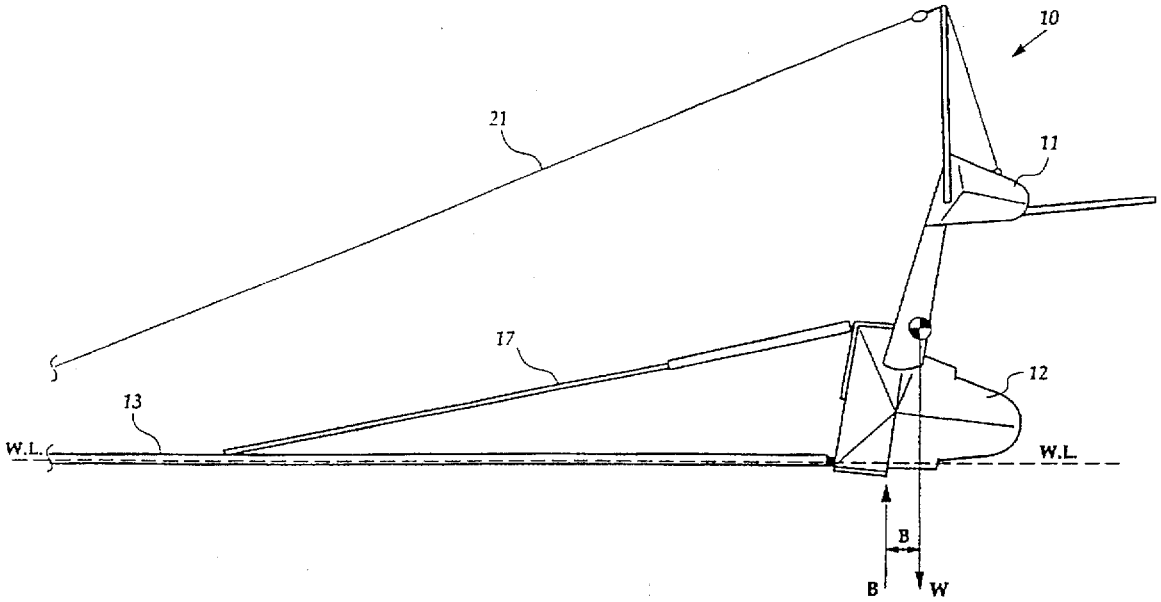
FIG. 4 illustrates the sail boat in partially capsized attitude.

Referring to FIGS. 3 and 4, it will be seen that the mast 13 as well as being inclined to leeward is supported adjacent the leeward side of the vessel such that in the event that the vessel is knocked down by the wind, the mast, which is preferably buoyant will extend across the surfaces of the water preventing a complete capsize of the vessel. Suitably the hull form is such that the centre of buoyancy of the vessel in the partly capsized position will be displaced towards the mast assembly whereby it will act through a force line F outward of the centre of gravity of the vessel acting through the forceline W resulting in a positive righting moment which will tend to self-right the vessel 10. This is assisted by the outward inclination of the mast, provided it does not submerge, as it will ensure that the hull of the vessel will only ever capsize through an angle of say seventy-five degrees, that is ninety degrees minus the outward inclination of the mast. The strut 17 is adjustable in length so that the mast 13 may be laid off to leeward in strong winds to provide effective reefing of the sail. Also the hull configuration whereby the underwater section of the main hull is lifted clear of the water in a 90 degree knockdown, tends the hull to assume a more stable position at less than a 90 degree knockdown, assisting the self righting.

The vessel 10 is relatively narrow, having a total trailing width W equal to or less than legal towing limits so that it will fit on a road trailer without the need to change the hull or mast configuration form its operative sailing configuration. All that is required to be done is to slide in the extension wing 66 to the leeward float 11 and which provides a crewing position in both the extended and retracted positions. Of course the features described above equally may be utilised on larger ocean-going craft. It will also be noted that the hulls are of similar length and have no longitudinal rocker. Furthermore the opposite sides at the bow are parallel to assist in accommodating the rudder case, only the lower part of which is submerged in use.

The strut 17 is length adjustable. In its shortest configuration it holds the mast in an inwardly inclined position so that when it is lowered it passed across the bow of the leeward hull. This assists in raising and lowering and off the boat. The normal sailing position is tilted outwardly to such extent that the resultant tendency to round up the vessel is countered by the forward location of the sail, this being suitably determined by providing sufficient movement in the stays 16/17 to actuate the rudder and automatic sail positioning controls.

In an alternative form of running rigging, each lower corner of the sail has two lines running to respective blocks which are spaced athwartship whereby the luff may be tensioned by pulling it to the windward block and the sail can be trimmed by the line passing through the leeward block in the manner of a conventional spinnaker arrangement, the opposite lines being used for the opposite tack.

It will of course be realised that the above has been given only by way of illustrative example of the invention and that all such modifications and variation thereto as would be apparent to persons skilled in the art are deemed to fall within the broad scope and ambit of the invention as is defined in the appended claims.

The claims defining this invention are as follow:

1. A proa sailing vessel comprising a hull assembly comprising a leeward hull and a windward hull both having underwater shapes which are substantially symmetrical about a central athwartships axis;

a mast assembly supported on the leeward hull and extending upwardly;

a sail assembly supported by the mast assembly, wherein the sail assembly is inclined to leeward of the leeward hull, whereby wind will spill from the sail as it inclines further to leeward before the windward hull is pivoted to a position out of the water;

running rigging means interconnected with said mast assembly and said sail assembly for causing the centre of effort of the sail assembly to be disposed forwardly of said central athwartships axis upon commencement of sailing in either direction, whereby the tendency of the vessel to round up to windward resulting from the leeward inclination of the sail assembly is counteracted by the forward position of the centre of effort of the sail assembly providing a counter tendency of the vessel to bear away from the wind.

2. A proa sailing vessel as claimed in claim 1, wherein said mast assembly is pivotably mounted to the leeward hull for movement in a fore-and-aft direction such that said mast assembly is forwardly inclined toward the operative forward end of the vessel, and wherein said sail assembly is set to leeward of said mast assembly and has an operative leading edge which is selectively tensioned by said running rigging means between the upper end of the forwardly inclined mast assembly and the operative forward end of the vessel.

3. A proa sailing vessel as claimed in claim 2, wherein said mast assembly is inclined to leeward of the leeward hull and said sail assembly includes a sail in the form of an isosceles triangle having stowing means spaced medially between its upstanding edges for engagement with a hoisting line extending to the upper end of the mast and by which hoisting line the sail may be raised and lowered.

4. A proa sailing vessel as claimed in claim 3, wherein said running rigging means includes control lines extending from the respective lower corners of the sail to respective laterally adjustable turning blocks supported at respective opposite ends of the hull assembly, the length of each upstanding edge of said sail being such that when tensioned by the respective control line the mast is pulled thereby to its forwardly inclined attitude.

5. A proa sailing vessel as claimed in claim 1, further comprising a rudder at each end of the leeward hull, each side rudder having a blade moveable between a raised inoperative position and a lowered operative position, wherein the blades are connected to said running rigging means, and wherein said running rigged means is configured such that the rudder blade at the rear of the vessel is moved to its lowered operative position and the rudder blade at the front of the vessel is moved to its raised inoperative position upon commencement of sailing in either direction.

6. A proa sailing vessel as claimed in claim 1, wherein said leeward hull is formed such that the vessel will be bouyantly supported by a protruding outside portion of the leeward hull, normally disposed above the water, when the vessel is pivoted to leeward to such extent that the mast assembly contacts the water.

7. A proa sailing vessel as claimed in claim 1, wherein said mast assembly is pivotably mounted to the leeward hull adjacent the leeward extremity of said leeward hull, and wherein said mast assembly is inclined to leeward therefrom.

8. A proa sailing vessel as claimed in claim 1, wherein said windward hull is provided with an extendable and retractable crew support which may be extended to windward of said windward hull.

9. A proa sailing vessel as claimed in claim 1, wherein hydrofoil means are provided on said windward hull to provide lift and to resist leeway.

10. A proa sailing vessel as claimed in claim 9, wherein said hydrofoil means is a depth adjustable foil supported in the windward hull at the central athwartships axis and inclined downwardly to windward.

11. A proa sailing vessel including:

a hull assembly comprising a leeward hull and a windward hull both having underwater shapes which are substantially symmetrical about a central athwartship axis;

a mast assembly supported on the leeward hull and extending upwardly whereby said mast assembly supports a sail assembly which is inclined to leeward of the leeward hull, whereby wind will spill from the sail as it inclines further to leeward before the windward hull is pivoted to a position out of the water, said sail assembly defining an upstanding edge extending upwardly from each of a pair of lower corners;

a rudder at each end of the leeward hull, each said rudder having a blade connected to said running rigging means whereby the rudder blade at the rear of the vessel is lowered and the rudder blade at the front of the vessel is raised upon commencement of sailing in either direction;

said running rigging means includes control lines extending from the respective lower corners of the sail assembly to respective laterally adjustable turning blocks supported at respective opposite ends of the hull assembly, the length of each upstanding edge being such that when tensioned by the respective control line the mast is pulled thereby to a forwardly inclined attitude;

said respective laterally adjustable turning blocks being connected to the adjacent rudders whereby the rear turning block is retracted and the front turning block is extended upon commencement of sailing in either direction, and;

wherein said control lines pass from the respective lower corners of the sail through the respective laterally adjustable turning blocks and about respective further turning blocks adjacent the respective corresponding ends of the windward hull for return to the operator.

12. A proa sailing vessel, comprising:

a hull assembly comprising a leeward hull and a windward hull rigidly interconnected together, wherein the leeward and windward hulls are substantially symmetrical about a central athwartships axis;

a mast pivotably mounted to the leeward hull for movement in a fore-and-aft direction such that the mast is forwardly inclined toward the operative forward end of the vessel;

a mast support pivotably interconnected with the leeward hull and connected to the mast for providing support to the mast during pivoting movement of the mast; and a sail supported by the mast.

13. A proa sailing vessel as claimed in claim 12, wherein the sail is inclined to leeward of the mast.

14. A proa sailing vessel as claimed in claim 13, wherein the mast is inclined to leeward of the leeward hull.

15. A proa sailing vessel as claimed in claim 14, wherein the mast is pivotably mounted to the leeward hull adjacent the leeward side of the leeward hull, and wherein the mast support is pivotably mounted to the leeward hull adjacent the windward side of the leeward hull.

16. A proa sailing vessel as claimed in claim 12, further comprising a crew support located between and interconnecting the leeward and windward hulls.

17. A proa sailing vessel as claimed in claim 16, wherein the crew support includes an extendable and retractable section movable to windward of the windward hull.

18. A proa sailing vessel as claimed in claim 12, further comprising a rudder at each end of the leeward hull, each rudder having a blade movable between a raised inoperative position and a lowered operative position, wherein the blades are interconnected with the mast such that the rudder blade at the rear of the vessel is moved to its lowered operative position and the rudder blade at the front of the vessel is moved to its raised inoperative position upon commencement of sailing in either direction.

19. A proa sailing vessel, comprising:

a hull assembly defined spaced ends;

a mast assembly mounted to the hull assembly;

a sail assembly supported by the mast assembly and including trim lines for trimming the sail assembly on respective port and starboard tacks;

a pair of rudder assemblies mounted to the hull assembly adjacent each end of the hull assembly, each rudder assembly being movable between an operative position and an inoperative position; and a connection arrangement interconnecting the trim lines and the rudder assemblies, wherein operation of the trim lines for trimming the sail assembly on respective port and starboard tacks functions to move one of the rudder assemblies to its operative position and the other of the rudder assemblies to its inoperative position.

20. A proa sailing vessel, comprising:

a hull assembly comprising a leeward hull and a windward hull;

a mast assembly secured to the leeward hull;

a sail supported by the mast assembly;

a hydrofoil mounted to the windward hull and extending downwardly therefrom for providing lift and resisting leeway, wherein the hydrofoil is movable throughout a range of positions for varying the lift and leeway resistance provided thereby, wherein the hydrofoil comprised a depth adjustable foil mounted at the central athwartships axis of the windward hull and inclined downwardly to windward.

21. A proa sailing vessel, comprising:

a hull assembly comprising a leeward hull and a windward hull;

a mast assembly secured to the leeward hull, wherein the mast assembly is pivotably mounted to the leeward hull and includes a pivotable mast support, wherein the mast assembly is pivotable in a fore-and-aft direction such that the mast is forwardly inclined toward the operative forward end of the vessel;

a sail supported by the mast assembly; and a hydrofoil mounted to the windward hull and extending downwardly therefrom for providing lift and resisting leeway, wherein the hydrofoil is movable throughout a range of positions for varying the lift and leeway resistance provided thereby.

* * * * *

UNITED STATES PATENT AND TRADEMARK OFFICE

CERTIFICATE OF CORRECTION

PATENT NO. : 5,724,905

DATED : March 10, 1998

INVENTOR(S) : JOHN KINGSTON PIZZEY

It is certified that error appears in the above-indentified patent and that said Letters Patent is hereby corrected as shown below:

Claim 5, column 9, line 5, delete "side" and substitute therefor -- said --; Claim 5, column 9, line 5, delete "moveable" and substitute therefor -- movable --; Claim 5, column 9, line 8, delete "rigged" and substitute therefor -- rigging --.

Signed and Sealed this

Second Day of June, 1998

*Attest:*

Bruce Lehman

BRUCE LEHMAN

*Attesting Officer*

*Commissioner of Patents and Trademarks*